US006926777B2

(12) United States Patent
Reppel et al.

(10) Patent No.: US 6,926,777 B2
(45) Date of Patent: Aug. 9, 2005

(54) METHOD FOR PRODUCING ROD-SHAPED PERMANENT MAGNETS

(75) Inventors: Georg Werner Reppel, Hammersbach (DE); Volker Zellmann, Linsengericht (DE)

(73) Assignee: Vacuumschmelze GmbH & Co. KG (DE)

( * ) Notice: Subject to any disclaimer, the term of this patent is extended or adjusted under 35 U.S.C. 154(b) by 122 days.

(21) Appl. No.: 10/129,559

(22) PCT Filed: Dec. 19, 2000

(86) PCT No.: PCT/EP00/12958

§ 371 (c)(1),
(2), (4) Date: Sep. 26, 2002

(87) PCT Pub. No.: WO01/46969

PCT Pub. Date: Jun. 28, 2001

(65) Prior Publication Data

US 2003/0110617 A1 Jun. 19, 2003

(30) Foreign Application Priority Data

Dec. 22, 1999 (DE) ..... 199 62 232

(51) Int. Cl.[7] ..... H01F 1/057

(52) U.S. Cl. ..... 148/101; 419/6; 419/12; 419/44; 419/45; 419/38; 419/57; 419/66; 419/68

(58) Field of Search ..... 419/6, 66, 68, 419/38, 45, 57, 12, 44; 148/101–104

(56) References Cited

U.S. PATENT DOCUMENTS 3,887,395 A * 6/1975 Martin ..... 148/301
3,892,598 A 7/1975 Martin
4,289,549 A * 9/1981 Kasai ..... 252/62.54
4,818,305 A 4/1989 Steingroever
4,859,410 A 8/1989 Brewer et al.
5,026,518 A * 6/1991 Suzuki et al. ..... 419/12
5,338,372 A 8/1994 Tabaru
5,382,303 A * 1/1995 Anderson et al. ..... 148/303
5,641,363 A * 6/1997 Fukuno et al. ..... 148/104
5,913,255 A 6/1999 Kikuchi et al.
6,599,465 B1 * 7/2003 Reppel et al. ..... 419/5

FOREIGN PATENT DOCUMENTS

| | | |
|---|---|---|
| DE | 78 36 712 U1 | 6/1979 |
| DE | 7903999 | 6/1979 |
| DE | 30 47 701 A1 | 7/1982 |
| EP | 0 124 655 B1 | 11/1984 |
| EP | 0 124 655 A2 | 11/1984 |
| EP | 0 515 854 A3 | 12/1992 |
| EP | 0 515 854 A2 | 12/1992 |
| EP | 0733424 | 9/1996 |
| FR | 2 526 994 | 11/1983 |

OTHER PUBLICATIONS

J. P. Jakubovics, "Magnetism and Magnetic Materials," *The Institute of Materials*, Table of Contents pp. v–vii, ix London (1994).

* cited by examiner

*Primary Examiner*—John P. Sheehan
(74) *Attorney, Agent, or Firm*—Dean W. Russell; Kilpatrick Stockton LLP

(57) ABSTRACT

The invention relates to a method for producing rod-shaped permanent magnets according to which pressed parts (2) are produced that are then assembled to a rod-shaped green product. Said green product is subsequently sintered, whereby a rod-shaped single-piece permanent magnet (1) is produced.

10 Claims, 1 Drawing Sheet

METHOD FOR PRODUCING ROD-SHAPED PERMANENT MAGNETS

Figure 1:
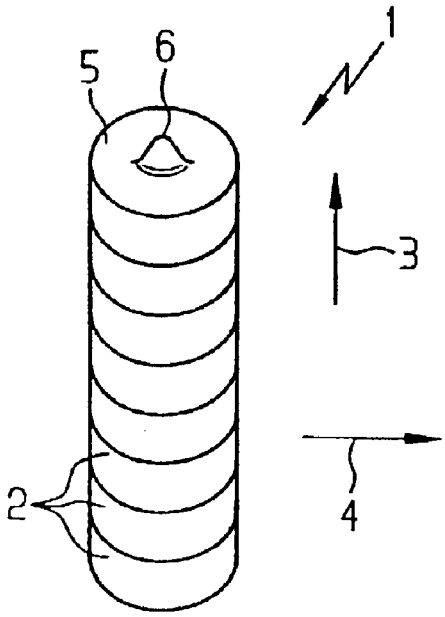

This application claims priority to German Application No. 199 62 232.9 filed on Dec. 22, 1999 and International Application No. PCT/E00/12958 filed on Dec. 19, 2000, the entire contents of which are incorporated herein by reference.

The invention relates to a process for the production of permanent magnets, in particular rod-shaped permanent magnets.

Permanent magnets of this type are needed for motors and generators. They typically have a diameter between 10 and 50 mm and a length between 20 and 200 mm. The preferred direction of magnetization for these permanent magnets can run in the axial or diametrical direction. The traditional production of these magnets with preferably diametrical preferred direction previously required a high expenditure.

From EB-A-0 124 655 principles of a production process for permanent magnets on the basis of rare earths, iron, and boron are known. In the known process a molten alloy on the basis of rare earths, iron, and boron is first pulverized and then pressed into green compacts in a magnetic field, said green compacts thereafter being sintered.

From the standpoint of pressing technology particularly good tablet-shaped pressed parts with a ratio of diameter to length near 1 can be pressed. After sintering the permanent magnets arising from these green compacts are next ground. The permanent magnets are subsequently bonded together so that their preferred directions of magnetization have the same direction. For this purpose it is required to align the permanent magnets with great precision during bonding. The required surface grinding, the aligning, and the bonding of the permanent magnets lead to great operational costs. In particular the aligning of the permanent magnets requires much working time or expensive apparatus.

Another possibility is to press rod-shaped permanent magnets in one piece. The pressing of a long, rod-shaped permanent magnet in the direction of its axis leads, however, to non-uniform pressing density and great deviations in mass resulting therefrom. Furthermore, special pressing with a large stroke is needed which, due to the large path, can achieve only low speeds. Alternatively, it would be possible to press the rod-shaped permanent magnet perpendicularly to its axis (lying flat). Since, however, it is not possible in this case to produce a circular cross-section, a suitable tubular form, by way of example a rounded square form, must be pressed. The lateral faces of the tubular form must be reground in order to achieve a circular cross-section, which is very expensive. Furthermore, it is very difficult in the case of large lengths to generate a transverse field which is homogeneous over the entire length of the green compact and thereby produce a magnetically homogeneous part.

Proceeding from the state of the art the objective of the invention is to provide a process with which, in particular, rod-shaped permanent magnets can be produced in a simple and cost-effective manner.

In the process according to the invention only the pressed parts and not the finished sintered parts are set on one another and fixedly connected to one another by sintering. Rod-shaped permanent magnets with good magnetic homogeneity arise thereby. The process advantageously requires neither an expensive grinding of finished permanent magnets nor a tiresome positioning of individual parts. The process according to the invention is thus significantly simpler and more cost-effective in comparison to traditional production processes.

Additional advantageous developments of the process are the object of the subordinate claims.

Figure 2:
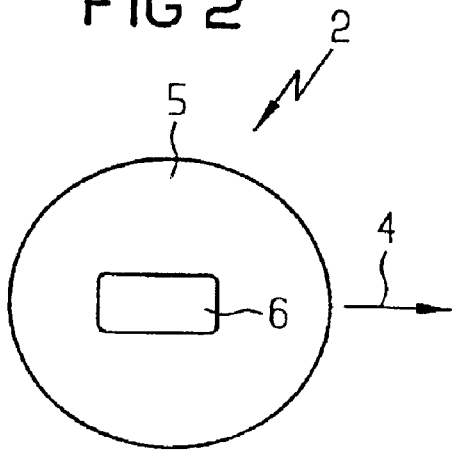
Figure 3:
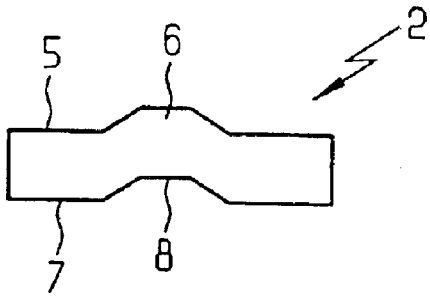
Figure 4:
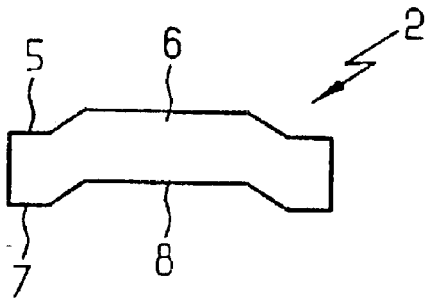

In the following the invention is explained in more detail with the aid of the accompanying drawings. Shown are:

FIG. 1 a perspective view of a rod-shaped permanent magnet produced with the process according to the invention, FIG. 2 a plan view of a pressed part which can be combined with like parts to form a rod-shaped permanent magnet, FIG. 3 a cross-section through an additional pressed part, and FIG. 4 a cross-section through an additional, modified pressed part.

FIG. 1 shows a rod-shaped permanent magnet 1 which is composed of several pressed parts 2. Permanent magnets 1 of this type are needed for motors and generators and typically have a diameter between 10 and 50 mm and a length between 20 and 200 mm. The permanent magnets 1 have either an axial preferred direction 3 of magnetization or a diametrical preferred direction 4 of magnetization.

As can be seen, in particular in FIG. 1 as well as in FIG. 2, the pressed parts 2 have raised areas 6 on one upper side 5. In case the pressed parts 2 have a diametrical preferred direction 4 of magnetization, the raised areas 6 are preferably formed so that the diametrical preferred direction 4 of magnetization of the pressed parts 2 points in the same direction when the pressed parts 2 are placed on one another.

FIGS. 3 and 4 show cross-sections through possible forms of embodiment of the pressed parts 2. It can be seen clearly that along with the raised area 6 on the upper side 5 an indentation 8 complementary to the raised area 6 is formed on the lower side 7 so that the pressed parts 2 can be placed together without a joint. The raised area 6 and the indentation 8 are preferably formed conically in order to make possible a problem-free joining of the pressed parts 2. The dimensions of the indentations 8 and raised areas 6 are chosen so that a join gap of customarily 0.05 mm results.

For the production of the permanent magnets 1, a rare earth-containing alloy is in general first melted and subsequently pulverized. From the powder, pressed parts are pressed. To set a preferred direction of magnetization the pressing process takes place in the presence of an external magnetic field. Subsequently the pressed parts 2 are joined together and sintered at temperatures above 800° C. In the case of the permanent magnets based on Nd—Fe—B, a liquid phase is formed along the upper sides 5 and the lower sides 7, said liquid phase connecting the pressed parts 2 in the hardened state. In each case a connection of the individual parts to one another results by diffusion during the sintering of the permanent magnets to the extent that there is good contact of the pressed parts. In order to get good strength in the connection, it has proven itself advantageous not to demagnetize the pressed parts 2 completely after the pressing in a magnetic field. The magnetic adhesive force then holds the pressed parts 2 together during handling and in the sintering oven up to the Curie temperature. Pressed parts 2 with diametrical preferred direction 4 of magnetization are preferably stacked on one another with alternating polarization.

A particularly good joining can be achieved with support of the force of gravity if the stacked rod-shaped permanent magnet 1 is sintered standing.

In order to achieve a very good resistance to corrosion of the permanent magnet 1, in particular at the join face, the rod-shaped permanent magnet 1 can be vacuum-impregnated or pressure-impregnated after sintering with known liquid plastics such as, for example, methacrylate. The plastic fills any pores and gaps which are present and hardens after the permanent magnet 1 has been saturated with the plastic.

The process described here has a series of advantages.

In comparison to rod-shaped permanent magnets which have been produced by bonding of finished sintered individual parts, the permanent magnet 1 has significantly greater strength since the pressed parts 2 form uniformly solid bodies after sintering.

Furthermore, the process is cost-effective since the pressed parts 2 are positioned by the correspondingly formed raised areas 6 and indentations 8 and surface grinding of the upper side 5 and the lower side 7 required for a good adhesive connection can be omitted. It is on the contrary even advantageous for a fixed sintered connection if the upper side 5 and the lower side 7 are roughened.

Since the pressed parts 2 are pressed individually, a tool with dimension on the order of magnitude of the dimensions of the pressed parts 2 is sufficient for the pressing of the pressed parts 2. In the case of small tools however, the magnetic field can be kept homogeneous with little expenditure. In comparison to traditional processes, in which the rod-shaped permanent magnets are pressed as a whole, permanent magnets 1 are thus significantly more homogeneous from the magnetic standpoint. Furthermore, permanent magnets 1 can be produced with the processes described here with a nearly arbitrary ratio of diameter to length.

For a fixed connection of the individual magnets based on rare earths, iron, and boron it has proven itself advantageous to set the amount of liquid sintered phase, i.e., the amount of rare earths in the alloy, somewhat higher than normal, say 1 to 5% by weight more rare earth.

The invention will be explained in more detail with the aid of the following examples:

1ST EXAMPLE

Comparative Example

Nd—Fe—B powder is pressed in a magnetic field to form round blanks with a diameter of 22 mm and a height of 10 mm with the application of a pressure of 250 MPa. Every four round blanks are stacked on one another to form a green compact and sintered standing at 1100° C. in a vacuum for 1 hour. After sintering, however, 60% of the finished sintered bodies were not connected. The remaining bodies can easily be separated by a blow.

2ND EXAMPLE

As in Example 1, where however the pressing tool has a lower punch with a raised area and an upper punch with an indentation. The pressed parts 2 represented in FIG. 3 resulted. The pressed parts 2 were not demagnetized and sintered standing. All the sintered parts were connected after sintering and could not be separated after a blow or fall from a height of 1 meter.

3RD EXAMPLE

As in Example 2 but the pressed parts were sintered lying flat. After sintering, 90% of the parts were fixedly connected and could not be separated after a blow or fall from a height of 1 meter.

4TH EXAMPLE

As in Example 1 but with a larger raised area 6 and indentation 8, as represented in FIG. 4. Pressing fractures occurred partially during pressing. All the error-free pressed parts were however fixedly connected after sintering and could not be separated after a blow or fall from a height of 1 meter.

5TH EXAMPLE

As in Example 1 but the composition of the alloy was varied according to Table 1.

| RE Content [% by weight] | Percentage of joined parts after sintering [%] |
|---|---|
| 28.7 | 16 |
| 31.2 | 100 |
| 33.4 | 100 |

This example shows that an excess of rare earths over the stochiometric rare earth content of the magnetically hard phase is advantageous for the strength of the connection with the composition $Nd_2Fe_{14}B$.

In conclusion let it be noted that the embodiments made here for permanent magnets of an alloy based on rare earths, iron, and boron also apply for permanent magnets of an alloy with the composition $RE_2(Fe, Co, Cu, Zr)_{14}$, where RE is at least one rare earth including yttrium.

Furthermore, the present description of the process is exemplary, in particular the joining of the pressed parts 2 is not intended to be restricted to rod-shaped permanent magnets.

What is claimed is:

1. A process for the production of permanent magnets which contain a phase having the composition $RE_2T_{14}B$, where T is at least one element selected from the group of elements consisting of Fe and Co, comprising:

production of a powder of an alloy containing at least one rare earth, pressing of the powder to form pressed parts, joining together of the pressed parts utilizing raised areas and indentations formed on the surface of the pressed parts to form a green compact, and sintering of the green compact, with the rare earth content of the permanent magnet being 1% to 5% by weight greater than the stoichiometric rare earth content of the hard-magnetic phase of the composition $RE_2T_{14}B$ and being less than or equal to 33.4% by weight, and a liquid phase, which connects the pressed parts to one another, being formed during the sintering.

2. The process according to claim 1 wherein the indentations have heights less than 0.5 mm.

3. The process according to claim 1 wherein the raised areas and indentations are formed conically.

4. The process according to claim 1 wherein the pressed parts have a preferred direction of magnetization and through the raised areas and indentations a uniform alignment of the preferred directions of magnetization of the pressed parts joined together to form the green compact is guaranteed.

5. The process according to claim 1 further comprising roughening surfaces of the pressed parts.

6. The process according to claim 1 wherein the permanent magnet contains a rare earth-rich phase with a percentage by weight of at least 2% by weight.

7. The process according to claim 1 wherein a solder of a rare earth-containing alloy with a percentage by weight of rare earth>10% by weight is applied to a common boundary surface of the pressed parts.

8. The process according to claim 1 wherein the pressed parts have at least a weak magnetic polarization.

9. The process according to claim 1 wherein the pressed parts stacked on one another are sintered standing.

10. The process according to claim 1 wherein the sintered joined body is impregnated with plastic.

* * * * *